US005711834A

United States Patent [19]

Saito

[11] Patent Number: 5,711,834

[45] Date of Patent: Jan. 27, 1998

[54] METHOD OF REINFORCING CONCRETE SLAB

[75] Inventor: Makoto Saito, Saitama-ken, Japan

[73] Assignee: Tonen Corporation, Tokyo, Japan

[21] Appl. No.: 547,175

[22] Filed: Oct. 24, 1995

[30] Foreign Application Priority Data

Oct. 28, 1994 [JP] Japan ..... 6-289292

[51] Int. Cl.[6] ..... B32B 31/00

[52] U.S. Cl. ..... 156/153; 52/746.1; 52/DIG. 7; 156/71; 156/161; 404/70

[58] Field of Search ..... 52/746.1, DIG. 7; 156/153, 161, 71; 404/70

[56] References Cited

U.S. PATENT DOCUMENTS

| | | | |
|---|---|---|---|
| 2,590,685 | 3/1952 | Coff | 404/70 |
| 2,752,275 | 6/1956 | Raskin et al. | 52/DIG. 7 |
| 4,556,338 | 12/1985 | Fahey . | |
| 5,308,430 | 5/1994 | Saito et al. . | |
| 5,326,630 | 7/1994 | Saito et al. . | |
| 5,447,593 | 9/1995 | Tanaka et al. | 52/DIG. 7 |
| 5,542,229 | 8/1996 | Saito et al. . | |
| 5,554,672 | 9/1996 | Saito et al. . | |

FOREIGN PATENT DOCUMENTS

| | | |
|---|---|---|
| 244377 | 1/1966 | Austria . |
| 0 378 232 | 7/1990 | European Pat. Off. . |
| 0 505 010 | 9/1992 | European Pat. Off. . |
| 2444768 | 8/1980 | France . |
| 2594871 | 8/1987 | France . |
| 16 84 293 | 10/1969 | Germany . |
| 2909179 | 9/1980 | Germany . |

OTHER PUBLICATIONS

Structural Preservation Systems, Inc./ Tonen Corporation, "Carbon Fiber Sheet Strengthening of Concrete and Masonry," (sales brochure; date unknown).

*Primary Examiner*—John J. Gallagher
*Attorney, Agent, or Firm*—Seidel Gonda, Lavorgna & Monaco, P.C.

[57] ABSTRACT

After sanding the upper surface 6 of a concrete slab 2, thermosetting resin 13 is poured onto the upper surface, and a unidirectional reinforcing fiber sheet is laid on the resin 13. The reinforcing fiber sheet is supported on the upper surface of the slab at the ends of the sheet by anchor pins 14 and maintained in a stretched state, to thereby impregnate the resin into the sheet and adhere the sheet to the upper surface of the slab. The resin-impregnated fiber sheet is then cured to reinforce the slab. The resin used has a viscosity of 5,000 cP or less at 20° C., a thixotropic index of 3 or less at 20° C., and a glass transition point of 60° C. or greater after hardening.

12 Claims, 7 Drawing Sheets

METHOD OF REINFORCING CONCRETE SLAB

FIELD OF THE INVENTION

This invention relates generally to methods for reinforcing concrete, and specifically to reinforcing concrete slabs.

Background of the Invention

Concrete slabs are routinely used in the construction of road bridges, parking lots, and warehouse floors. It is often desirable, or even necessary, to reinforce these slabs to provide strengthening in order to meet the demands placed upon the slabs due to applied stresses.

The most common method for reinforcing concrete slab is the mounting of steel plate to the underside of a slab, such as the underside of a bridge. However, this method is unsuitable or impractical for reinforcement of heavily traveled surfaces such as the road surface of the bridge example.

In order to reinforce the upper surface of a road bridge concrete slab, for example, an alternative method is available. This method entails removing the asphalt laid upon the slab, sandblasting the exposed concrete surface, laboriously leveling the exposed concrete slab, applying a resin mortar, and then applying a resin-impregnated unidirectional reinforcing fiber sheet. Finally, asphalt is re-applied to the fiber sheet. The problem with this current method of concrete slab reinforcement is that the required sanding or sandblasting of the exposed concrete surface further requires a time-consuming effort to apply resin mortar in a level fashion. An unavoidable unevenness on the concrete surface results in undesirable thread twisting of the affixed unidirectional reinforcing fiber sheet. The thread twisting decreases the reinforcing properties of the fiber sheet.

Thus, a need exists for a method of reinforcing concrete slab that does not require extensive surface preparation, such as leveling following sanding, in order to receive a reinforcing fiber sheet.

SUMMARY OF THE INVENTION

The present invention is directed to a method that satisfies the need for a process for concrete slab reinforcement which secures a unidirectional reinforcing fiber sheet to the upper surface of a concrete slab, whereby strengthening can be achieved without the need for laborious leveling work following sanding treatment.

The invention is a method of reinforcing a concrete slab comprising the steps of sanding an upper surface of a concrete slab by a thickness of 0.2 mm or more, then pouring a thermosetting resin on the upper surface, wherein the resin is selected from a group consisting of epoxy resin, unsaturated polyester resin, and vinyl ester resin. The resin has a viscosity of 5,000 cP or less at 20° C., a thixotropic index (TI) of 3 or less at 20° C., and a glass transition point (Tg) of 60° C. or greater. A unidirectional reinforcing fiber sheet is laid over the top of the resin and maintained in a stretched state. The resin is then impregnated into the reinforcing fiber sheet, adhered to the fiber sheet, and allowed to harden.

According to one form of the invention, the subject concrete slab is a road bridge slab with asphalt paving on the concrete surface.

In another embodiment of the invention, a 0.1–5.0 wt. % silane coupling agent can be incorporated into the thermosetting resin in order to prevent the weakening of the reinforcing fiber's adhesive strength attributable to moisture present in the upper surface of the concrete slab.

BRIEF DESCRIPTION OF THE DRAWINGS

For the purpose of illustrating the invention, there is shown in the drawings a form of the method which is presently preferred; it being understood, however, that this invention is not limited to the precise arrangements shown.

DETAILED DESCRIPTION OF THE DRAWINGS

Figure 1:
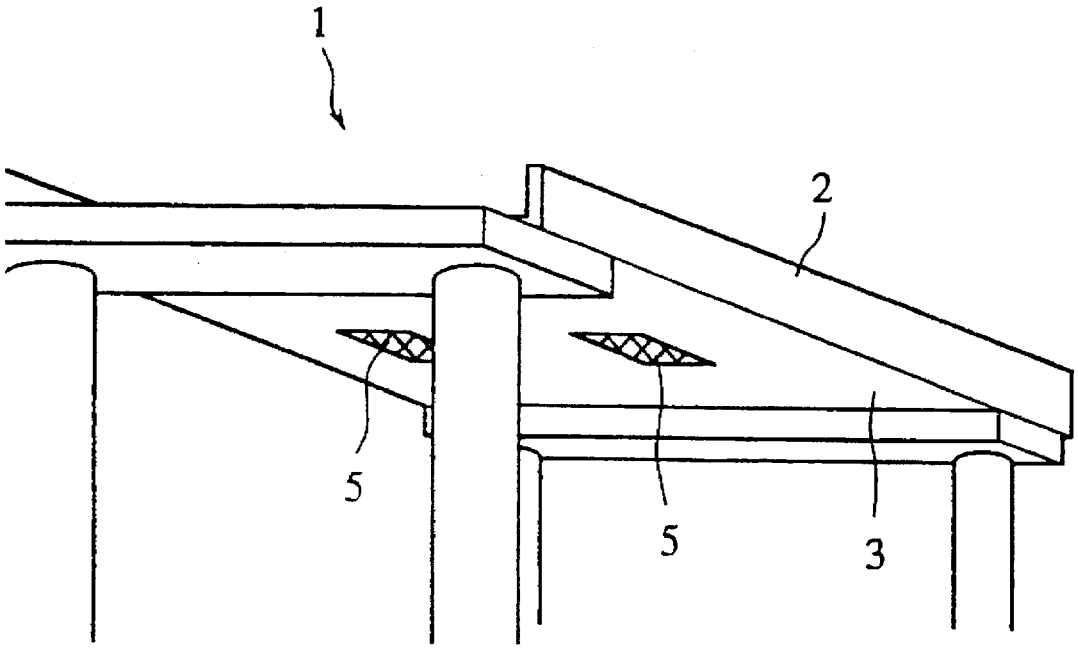
FIG. 1 is a perspective view showing a conventional reinforcement method for a concrete slab using steel plates.

Referring to the drawings, wherein like numerals refer to like elements, the method of the present invention is illustrated, along with currently available methods for reinforcing concrete slabs and methodologies used to test the physical properties of samples subjected to the method of the present invention.

FIG. 1 shows the common method of reinforcing a road bridge 1. The road bridge 1 has a concrete slab 2, of which the fragile, weathered layer of an underside 3 is sanded. Steel plates 5 of thickness ranging from 6 mm–9 mm are applied and secured with anchor bolts to the underside 3 of the concrete slab 2. Resin is poured between the slab 2 and the steel plates 5, bonding the steel plates 5 to the underside 3 of the slab 2. This method is unsuitable for reinforcement needs on the upper surface of a road bridge.

Figure 2A:
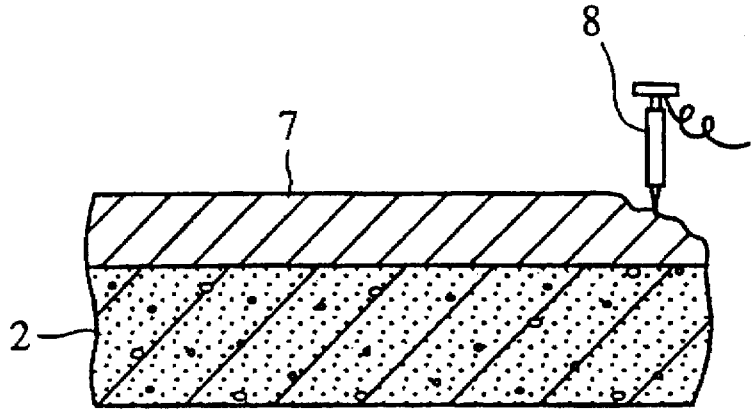
FIGS. 2(*a*) through 2(*c*) are process diagrams showing a conventional reinforcement method employing a unidirectional reinforcing sheet.
Figure 2B:
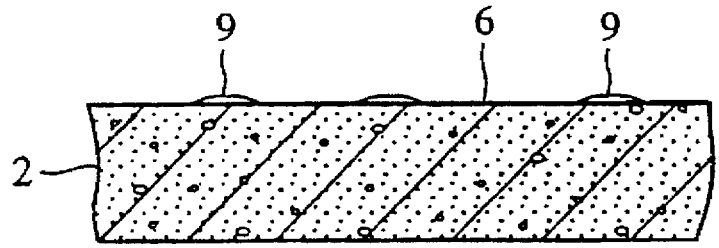
Figure 2C:
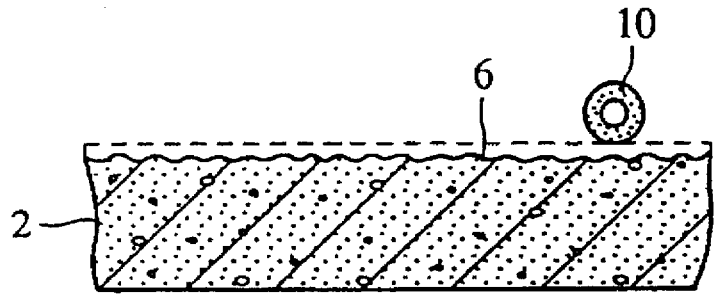

FIGS. 2(*a*) through 2(*c*) show the commonly used method of reinforcing an upper surface, or "road surface," of road bridge concrete slab. Asphalt 7 is removed from the concrete slab 2 with a rock drill 8. A power shovel may then be used to remove crushed asphalt, leaving an upper surface 6 of concrete slab 2 exposed. Oil content 9 is often present on the upper surface 6 of the exposed slab 2. The oil content 9 must be removed, and this is done by sandblasting or through the use of a disk sander 10. A result of the sanding operation is an uneven upper surface 6.

Figure 3A:
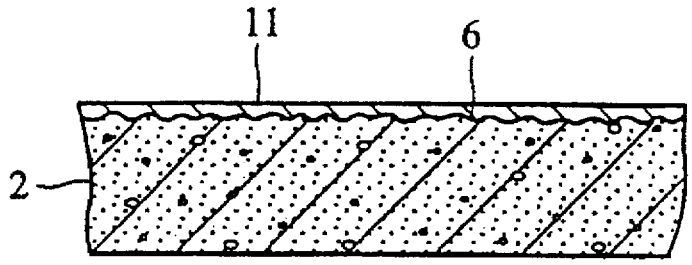
FIGS. 3(*a*) through 3(*c*) are process diagrams that are a continuation of the process detailed in FIGS. 2(*a*) through 2(*c*).
Figure 3B:
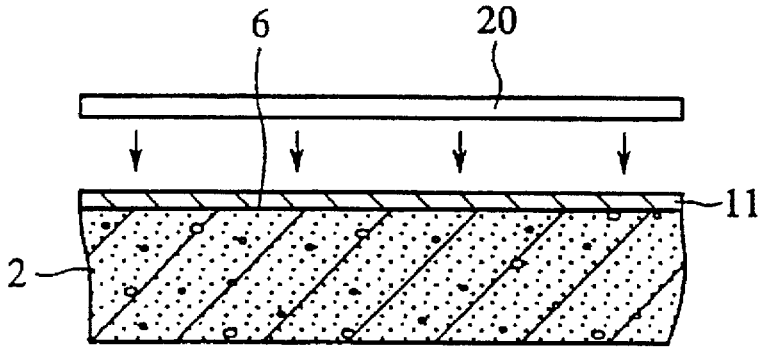
Figure 3C:
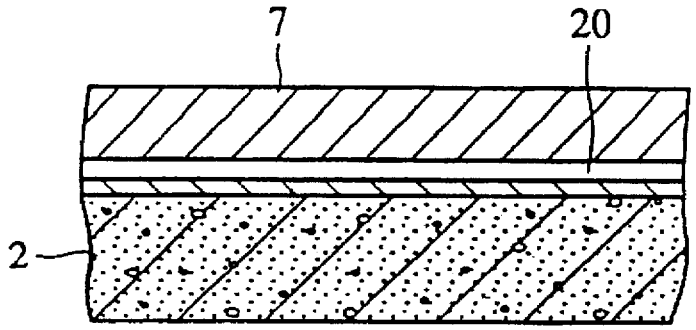

Continuing in FIGS. 3(*a*) through 3(*c*), a resin mortar 11 is applied to the uneven upper surface 6 of the concrete slab 2. The resin mortar 11 is carefully applied by trowel and the unevenness levelled. Thereafter, a unidirectional reinforcing fiber sheet 20 is affixed to the levelled upper surface 6. The resin 11 hardens and the reinforcing fiber sheet 20 solidifies. By application of the solidified reinforcing fiber sheet 20, the upper surface 6 of the concrete slab 2 is strengthened or repaired. Asphalt 7 is then laid upon the solidified reinforcing fiber sheet 20, and the strengthening or repair of the concrete slab 2 complete.

The distinct feature of the present invention is that a thermosetting resin of desired physical properties is used. This fluent resin is used without having to level the concrete slab's upper surface after sanding. Rather, the more fluent resin is poured onto the exposed and sanded concrete slab surface. By then laying a reinforcing fiber sheet on the resin, and maintaining the sheet in a stretched state, the resin is made to impregnate the reinforcing fiber sheet and the sheet, in turn, made to adhere to the upper surface of the concrete slab.

Figure 4A:
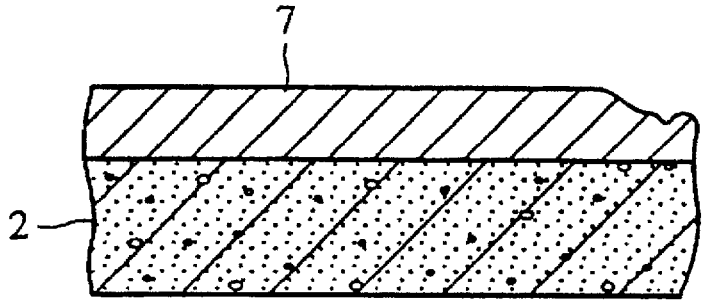
FIGS. 4(*a*) through 4(*c*) are process diagrams that show one embodiment of the method of reinforcing a slab using a unidirectional reinforcing fiber sheet according to this invention.
Figure 4B:
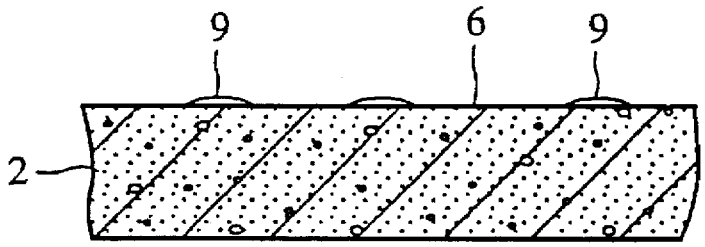
Figure 4C:
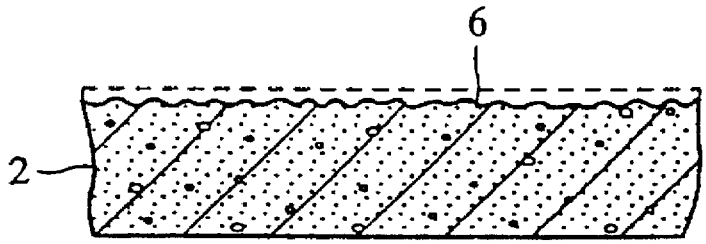
Figure 5A:
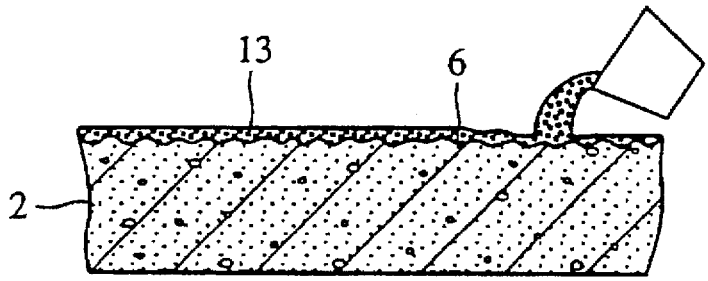
FIGS. 5(*a*) through 5(*d*) are process diagrams that show a continuation of the process detailed in FIGS. 4(*a*) through 4(*c*).
Figure 5B:
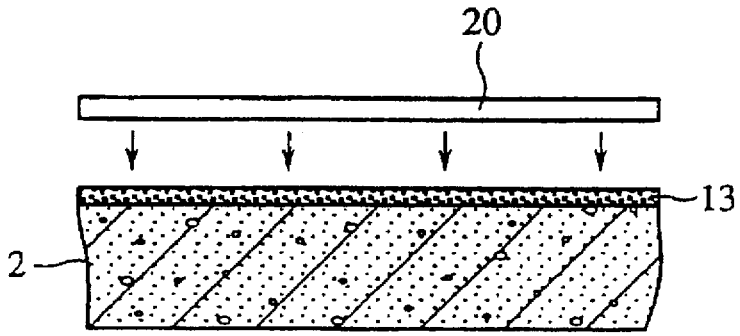
Figure 5C:
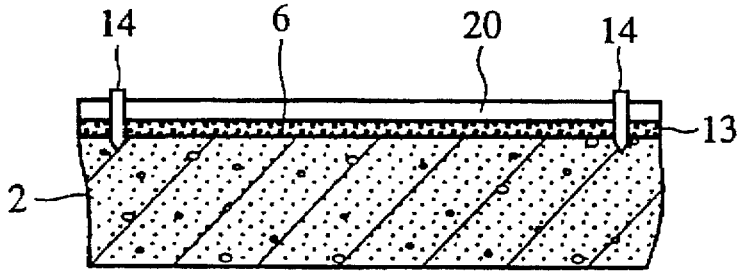
Figure 5D:
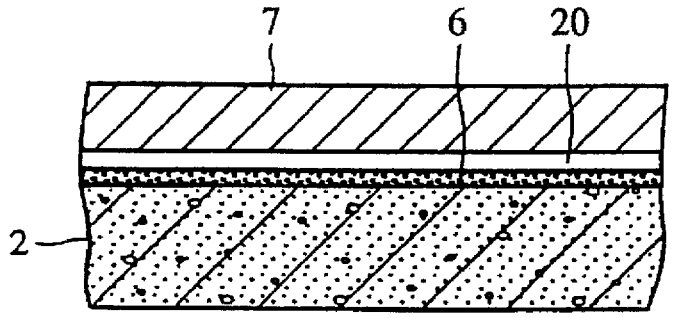

The invention is shown in more detail in FIGS. 4(*a*) through 4(*c*), and continuing with FIGS. 5(*a*) through 5(*d*). In these Figures, the method of concrete reinforcement according to the invention is illustrated as applied to concrete slabs of road bridges.

As shown in FIGS. 4(*a*) through 4(*c*), asphalt 7 is removed from a concrete slab 2, using a rock drill or other means known in the art for asphalt removal. With the upper surface 6 of the concrete slab 2 exposed, the exposed upper surface 6 is sanded or sandblasted so that any oil content 9 remaining on the upper surface 6 is removed. A thickness of 0.2 mm or more is removed from the upper surface 6. Up to this point, the method of the present invention is the same as conventional methods.

As shown in FIGS. 5(*a*) through 5(*d*), a thermosetting resin 13 is poured onto the upper surface 6. There is no effort made to level the unevenness of the upper surface 6 caused by the sanding treatment before the resin 13 is poured. The unidirectional reinforcing fiber sheet 20 is then laid on top of the resin 13. Anchor pins 14 are driven through the reinforcing fiber sheet 20 and into the upper surface 6 of the concrete slab 2. The reinforcing fiber sheet 20 is kept in a tightly stretched state on top of the resin 13 by anchor pins 14.

When the reinforcing fiber sheet 20 is applied to the resin 13 on the upper surface 6 of the concrete slab 2, and the resin cured, it is important to secure the ends of the reinforcing fiber sheets 20 laid over the poured resin 13 with anchor pins 14, and to support the reinforcing fiber sheets 20 in a tightly stretched state. If the process is not executed in this manner, the fibers of the reinforcing fiber sheet cause thread twisting because of the unevenness of the upper surface of the slab. As a result, the reinforcing effect of the reinforcing fiber sheet becomes impossible to adequately obtain. The supporting sheet 17 and the adhesive layer 18 of the reinforcing fiber sheet 20 are not removed from the reinforcing fiber sheet 20 after the reinforcing fiber sheet 20 has been applied to the resin 13 on the concrete slab 2.

The resin 13 is thereafter impregnated into the reinforcing fiber sheet 20 and, additionally, the resin-impregnated reinforcing fiber sheet 20 becomes bonded to the upper surface 6 of the concrete slab 2. The impregnated resin 13 is heat-hardened, or in the case of thermosetting resins, allowed to cure or harden at room temperature. Thus, the reinforcing fiber sheet 20, maintained in a stretched state, solidifies. Finally, asphalt 7 is once again laid on top, and the reinforcement or repair work is completed.

Figure 6:
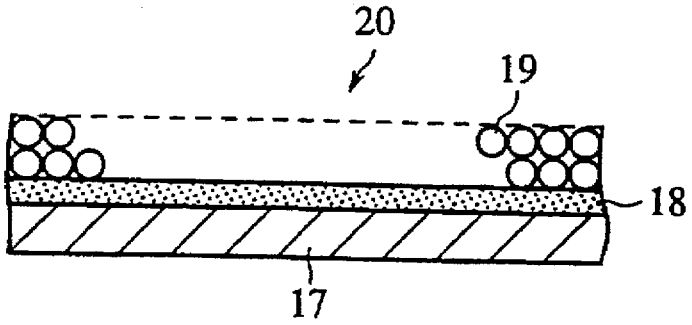
FIG. 6 is a cross-sectional view, on an enlarged scale, of the unidirectional reinforcing fiber sheet used in the present invention.

The unidirectional reinforcing fiber sheet 20 used in the invention is shown in FIG. 6. It is formed by arranging reinforcing fibers 19 in a single direction on a supporting sheet 17. The reinforcing fibers 19 are secured to the supporting sheet 17 by application of an adhesive layer 18. The reinforcing fibers 19 may be made of polyester, polyethylene, steel, alamide, boron, glass, carbon, or similar materials. Carbon fibers are found to be particularly suitable. The quantity of reinforcing fibers used to make the reinforcing fiber sheet is in the range of about 100 to about 500 g/m$^2$; the preferred embodiment uses about 150–350 g/m$^2$. The supporting sheet 17 of the reinforced fiber sheet 20 can be glass cloth, scrim cloth, release paper, nylon film, or similar material. The thickness of the supporting sheet 17 is about 1 to about 500 μm, but preferably is about 5 to about 100 μm. The adhesive agent constituting the adhesive layer 18 may be epoxy resin, unsaturated polyester resin, and vinyl ester resin, or similar adhesive agent. The quantity of resin used for the adhesive layer 18 is about 1 to about 50 g/m$^2$, but preferably about 2 to about 15 g/m$^2$.

The thermosetting resin 13 used in the invention is selected from the group consisting of epoxy resin, unsaturated polyester resin, or vinyl ester resin. Moreover, the viscosity of this resin at 20° C. is specified as 5,000 cP or less. The thixotropic index at 20° C. for the resin is 3 or less. The glass transition point for the resin, after hardening, is specified as 60° C. or greater.

A resin 13 viscosity of 5,000 cP or less, at 20° C., is specified in this invention because an improved fluidity of the resin allows the resin to be poured over the upper surface 6 of the concrete slab 2 and settle into a smooth horizontal surface with no unevenness.. The specified resin viscosity also ensures that the resin will become impregnated into the reinforcing fiber sheet 20 because such a viscosity improves the permeability of the resin into the reinforcing fiber sheet. If the resin viscosity is greater than 5,000 cP, a smooth surface on the poured resin cannot be obtained, thus requiring the time-consuming task of leveling the poured resin. Furthermore, a resin having a viscosity higher than 5,000 cP does not reach the fine indentations of the upper surface of the concrete slab when poured. As a result, the reinforcing fiber sheet cannot adequately bond to the upper surface of the concrete slab. Therefore, it is preferable for the resin to have a viscosity in the range of about 2,000 to about 4,000 cP at 20° C.

Up until now, concrete reinforcing methods using the reinforcing fiber sheet have utilized a resin having a thixotropic index greater than 3. Thus, in those instances where the resin was poured onto the upper surface of the concrete slab without having leveled the surface subsequent to a sanding treatment, resin flowability was poor. The leveling work then required was time-consuming. Further, the resin failed to go into the fine bumps and depressions resulting from the sanding treatment. This caused inadequate bonding of the reinforcing fiber sheet to the concrete slab. Dealing with poor resin flow and inevitably poor bonding between reinforcing fiber sheet and concrete slab required troublesome leveling work.

It is therefore an object of the invention to present a method for concrete reinforcement that omits the troublesome leveling required following the sanding treatment.

The thixotropic index, TI, of the resin is measured using a B-type rotational viscometer; TI is a ratio comparing viscosity measured at 5 rpm to that viscosity measured at 50 rpm. The relationship defining TI can be expressed as:

$$TI = \text{viscosity (at 5 rpm)}/\text{viscosity (at 50 rpm)}$$

The thixotropic index of the resin 13 used in the present invention is specified to be 3 or less, at 20° C. This TI is specified to ensure weakening of the sag stopping effect, thus allowing the resin to adequately and evenly cover the entire upper surface 6 when poured. If the resin has a TI exceeding 3, the resin hardens due to the sag stopping effect and fails to reach the entire surface, including the fine depressions of the upper surface's concrete structure. This further causes inadequate bonding of the reinforcing fiber sheet 20 to the upper surface 6 of the concrete slab 2. Therefore, the preferable thixotropic index of the resin 13 at 20° C. is about 1 to about 2.5.

The glass transition point, Tg, of the resin used in the present invention is specified to be 60° C. or more. This value for Tg is chosen because direct sunlight striking the asphalt of a road bridge during the summer months causes the temperature of the asphalt to increase to 50° C. or more. As a result, the tensile strength of a reinforcing fiber sheet drops sharply if the glass transition point of the resin impregnated in the reinforcing fiber sheet is below the preferred value. A decrease in the tensile strength of the reinforcing fiber sheet causes its reinforcing effect to decrease significantly. Therefore, in view of safety, it is necessary to make the resin's glass transition point 60° C. or greater. It is similarly beneficial to construct concrete slabs for parking lot floors or warehouse floors so that the decrease in the strength of reinforcing fiber sheets is prevented when the slabs are heated close to 60° C. It is preferable that the resin 13 have a glass transition point, after hardening, of about 65° to about 80° C.

It is preferable that the resin 13 be applied to the upper surface 6 as the first layer of undercoat in a quantity of about 0.3 to about 3.0 kg/m$^2$. A quantity of resin less than 0.3 kg/m$^2$ is not adequate to fill in the unevenness of the upper surface 6 caused by sanding treatment, and will not permit a smooth surface on the resin 13. Conversely, if the applied quantity of resin exceeds 3.0 kg/m$^2$, there is too much resin and it is wasted. The preferable amount of resin is about 0.5 to about 1.5 kg/m$^2$.

The presence of moisture content inside the concrete slab 2 can affect the adhesive strength of the reinforcing fiber sheet 20 to the upper surface 6 of the concrete slab 2. In order to remove the effect of moisture in the concrete slab, it is possible to incorporate silane coupling agent to the resin 13. The silane coupling agent is incorporated with the resin in the ratio of about 0.5 to about 5.0 wt. %.

According to the invention, asphalt 7 is reapplied after the reinforcing fiber sheet 20 solidifies. It is possible to spread sand on the reinforcing fiber sheets before the resin impregnated into the reinforcing sheet hardens. The use of sand serves to block asphalt heat, further improve adhesion of the asphalt, and prevent slip with the solidified reinforcing fiber sheet 20. The sand can be coarse, grain-size silica sand. A sand grain size of about 0.5 to about 5.0 mm is desirable. A preferable amount of sand is about 1.0 to about 5.0 kg/m$^2$.

The reinforcing method of the invention, as outlined above, has the following advantages:

(1) While the unidirectional reinforcing fiber sheet 20 is thin, and in particular unidirectional carbon fiber sheet, the fiber sheet has a strong reinforcing effect and easy workability;

(2) Because the reinforcing fiber sheet 20 is thin, there is almost no difference in level when the reinforcing fiber sheet is worked on the upper surface 6 of the concrete slab 2. Asphalt 7 laid upon the reinforcing fiber sheet 20 lasts a long time without peeling;

(3) The thermosetting resin 13 has relatively low viscosity and low thixotropy. Thus, a smooth surface on the poured resin 13 can be easily obtained when the resin 13 is poured on the upper surface 6 of the slab 2. It is not necessary to level the upper surface 6 of the slab 2 following the sanding treatment;

(4) Resin 13 will go into large cracks on the upper surface 6 of the slab 2, and can therefore be expected to be effective in repairing cracks; and (5) Adequate bonding strength of the reinforcing fiber sheet 20 can be obtained with a wet upper surface 6 by combining a silane coupling agent in the resin 13. The upper surface 6 may be wet due to rain water penetration or the use of water during the cutting of the asphalt pavement.

Below, test examples according to the invention are explained, with reference to Table 1.

Figure 7:
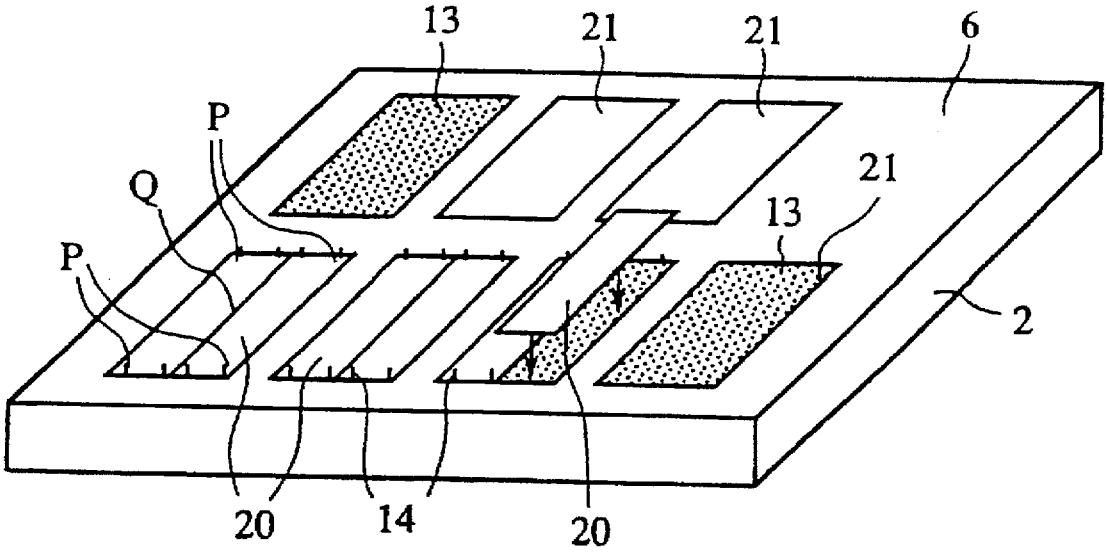
FIG. 7 is a perspective view that shows the methodology employed for the workability/adhesiveness tests in test samples for this invention.

As shown in FIG. 7, tests were conducted on the workability and adhesiveness of the reinforcing fiber sheet 20. A concrete slab 2 cut from an existing road bridge was used.

After removing asphalt remaining on the upper surface 6 of the slab 2, sanding treatment was applied to seven locations on the upper surface 6 of the slab 2 in areas measuring 1 m×1 m. Thus, seven test surfaces 21 were produced (Case Nos. 1–5: Comparative Examples and Case Nos. 6–7: Examples). Resin 13 was poured onto each test surface 21, at its central location, in the amount of 1 kg/m$^2$. Two unidirectional carbon fiber sheets, each measuring 1 m (l)×0.5 m (w), were laid side by side on top of the resin 13. The unidirectional carbon fiber sheets serving as unidirectional reinforcing fiber sheet 20 were manufactured by Tonen Corporation (FORCA TOW SHEET FTS-CI-30). The reinforcing fiber sheets 20 were maintained in a stretched state, and their ends were supported by anchor pins 14. Only one layer of the reinforcing fiber sheet 20 was used. The reinforcing fiber sheets were cured indoors for one week, allowing the resin 13 to permeate into the stretched reinforcing fiber sheets 20 and allowing the reinforcing fiber sheets 20 to bond to the test surfaces 21. The cured reinforcing fiber sheets became the testing samples.

Adhesion tests on the samples were conducted in accordance with the KEN KEN SHIKI method. Visual observations were made for evidence of thread twisting. Five locations on each test sample were evaluated: The four opposite angle positions P of the square formed by the two reinforcing fiber sheets, and the central area Q.

Each treated surface received one of two types of sanding treatment. Sanding Treatment A was a disk sander treatment, with an average thickness of approximately 0.1 mm being ground from the surface. Sanding Treatment B was a sandblast treatment, with an average thickness of 0.3 mm being ground from the surface.

Thermosetting resin 13 employed in the testing consisted of the following three types: (1) Tonen-manufactured FR resin FR-E3P, an epoxy resin having a viscosity at 20° C. of 24,000 cP, a TI of 4.1, and Tg of 50° C.; (2) Tonen-manufactured FR resin FR-E3, an epoxy resin having a viscosity at 20° C. of 2,000 cP, a TI of 2.3, and Tg of 50° C.; and (3) Tonen-manufactured FR resin FR-E5, an epoxy resin having a viscosity at 20° C. of 1,500 cP, a TI of 1.8, and Tg of 70° C.

Evaluation results are shown in Table 1. As can be seen from Table 1, satisfactory results were obtained with regard to external appearance and adhesiveness, following curing, for cases 5, 6, and 7. The resin used in Case No. 5 was outside the range of the invention.

Using the three resins employed in the aforementioned workability and adhesiveness tests, tests were conducted to evaluate performance at high temperatures. One layer of Tonen-manufactured unidirectional carbon fiber sheet (FORCA TOW SHEET, FTS-CI-300) was applied to mortar board and cured for seven days at 20° C. A tension test in conformance with JIS K7073 was carried out at room temperature. A mortar adhesion test in conformance with JIS A6909 was also carried out at room temperature. Thereafter, similar tension and mortar adhesion tests were conducted in a 60° C. atmosphere on samples that had cured for seven days at 20° C. and samples that had cured for one day at 60° C. The results of the tests are shown in Table 2.

Figure 8A:
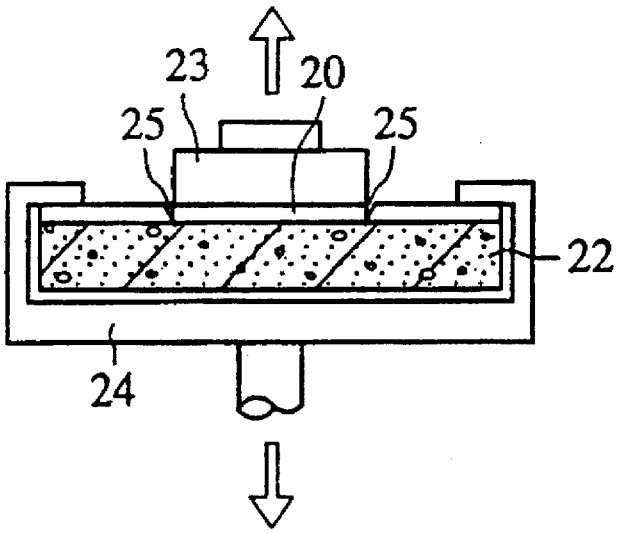
FIGS. 8(*a*) through 8(*c*) show the methodology of the adhesion test utilized in durability testing for test samples subject to the present invention.
Figure 8B:
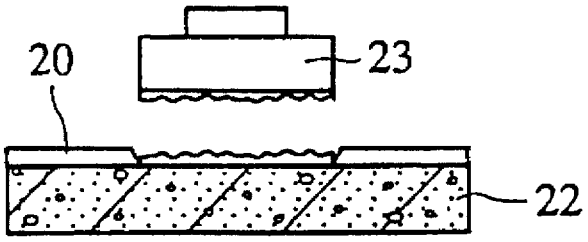
Figure 8C:
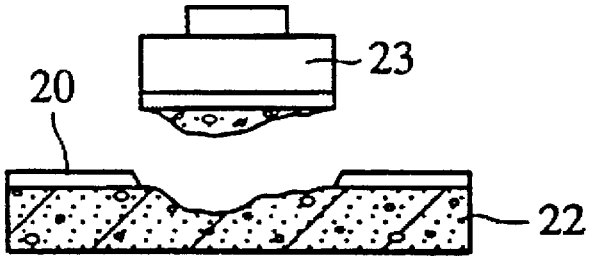

FIGS. 8(*a*) through 8(*c*) show the methodology of the mortar adhesion test. A steel attachment 23 was attached with an adhesive to the reinforcing fiber sheet 20, which itself had been applied to the upper surface of the mortar piece 22. The mortar piece 22 was then set into a stationary jig 24 of a tension test apparatus (not shown). A pull out test was carried out with the aid of the steel attachment 23. The reinforcing fiber sheet was cut to the mortar layer 22 at each end of the attachment 23 before the adhesion test was conducted.

In Table 2, the reported tensile strength values at room temperature and 60° C. refer to the tensile strength at the designed thickness base. These values were obtained by dividing the breaking load by the designed thickness of the reinforcing fiber sheet and the test sample width. Also, the term "sheet failure" refers to the failure mode expressed in FIG. 8(*b*), where the breakage occurred within the sheet which had been applied to the mortar piece surface. Sheet failure indicates that at 60° C. the performance of the resin is poor. "Mortar bulk failure" refers to the failure mode shown in FIG. 8(*c*). Here, the breakage occurred inside the mortar piece, indicating that at 60° C. the performance of the resin is good.

As Table 2 shows, the epoxy resin FR-E5 (viscosity at 20° C.=1,500 cP, TI at 20° C.=1.8, Tg=70° C.) displayed good performance at 60° C. Among the room temperature evaluations in Table 1, Case No. 5 (with epoxy resin FR-E3) was satisfactorily similar to Case Nos. 6 and 7. However, as indicated in the 60° C. test results of Table 2, the performance at 60° C. of resin FR-E3 is poor because the Tg of this resin is low (50° C.). It is therefore determined that only the embodiments of the invention, as evaluated in Case Nos. 6 and 7, are satisfactory.

According to the reinforcement method of this invention, unidirectional reinforcing fiber sheet is applied to the upper surface of a concrete slab of, for example, a road bridge. This method precludes the need for laborious leveling work following sanding. The resin prescribed by this method can permeate reinforcing sheets and further fill cracks and indentations in the concrete surface. The reinforcement method of this invention can be carried out simply and effectively.

TABLE 1

| | Case Nos. | Sanding treatment | Resin used | Sheet end fixing | External appearence after curing (Thread looseness) | Adhesion test results: Failure mode | Adhesion test results: Average strength (individual datum) | Judgement |
|---|---|---|---|---|---|---|---|---|
| Comparative Examples | 1 | A (Sander, 0.1 mm$^t$) | FR-E3 | None | ○: Satisfactory with no thread twisting | X: Concrete bulk failure: 2 Interfacial failure: 3 | 19 kgf/cm$^2$ (30, 28, 15, 11, 10) | X |
| | 2 | A | FR-E5 | None | ○: Satisfactory with no thread twisting | X: Concrete bulk failure: 3 Interfacial failure: 2 | 23 kgf/cm$^2$ (36, 31, 25, 8, 13) | X |
| | 3 | A | FR-E3P | None | X: The resin was poured on the center and reached only a radius of approx. 30 cm from the center, and it was not possible to work the entire 1 m × 1 m surface | — | — | X |
| | 4 | B (Sand blast, 0.3 mm$^t$) | FR-E3 | None | X: Substantial thread twisting due to the unevenness of the under coat | ○: Concrete bulk failure: 5 | 37 kgf/cm$^2$ (40, 35, 33, 33, 43) | X |
| | 5 | B | FR-E3 | The sheet was cured while maintaining it in a stretched state by fixing the ends with dry bits | ○: Satisfactory with no thread twisting | ○: Concrete bulk failure: 5 | 36 kgf/cm$^2$ (40, 33, 29, 35, 42) | ○ |
| Examples | 6 | B | FR-E5 | The sheet was cured while maintaining it in a stretched state by fixing the ends with dry bits | ○: Satisfactory with no thread twisting | ○: Concrete bulk failure: 5 | 37 kgf/cm$^2$ (33, 42, 38, 33, 40) | ○ |
| | 7 | B | FR-E5 | The sheet was cured while maintaining it in a stretched state by fixing the ends with gum tape | ○: Satisfactory with no thread twisting | ○: Concrete bulk failure: 5 | 36 kgf/cm$^2$ (33, 45, 29, 35, 37) | ○ |

TABLE 2

| | Comparative Examples | | Examples |
|---|---|---|---|
| | FR-E3P | FR-E3 | FR-E5 |
| Room temperature tensile strength: average values | 453 kgf/mm$^2$ | 445 kgf/mm$^2$ | 450 kgf/mm$^2$ |
| (Maximum/Minimum) | (483/418) | (474/420) | (467/440) |
| 60° C. tensile strength: average values | 286 kgf/mm$^2$ | 293 kgf/mm$^2$ | 403 kgf/mm$^2$ |
| (Maximum/Minimum) | (303/270) | (308/280) | (421/376) |
| Room temperature adhesion test: average values | 21 kgf/mm$^2$ | 21 kgf/mm$^2$ | 22 kgf/mm$^2$ |
| (individual data) | (22, 22, 20) | (21, 21, 20) | (23, 20, 22) |
| Failure mode | Mortar bulk failure | Mortar bulk failure | Mortar bulk failure |
| 60° C. Adhesion test: average values | 8 kgf/mm$^2$ | 9 kgf/mm$^2$ | 21 kgf/mm$^2$ |
| (Maximum/Minimum) | (7, 8, 8) | (8, 7, 18) | (20, 22, 21) |
| Failure mode | Sheet failure | Sheet failure | Mortar bulk failure |
| Judgement | Unsatisfactory | Unsatisfactory | Satisfactory |

What is claimed is:

1. A method of reinforcing a concrete slab comprising:

sanding an upper surface of a concrete slab by a thickness of 0.2 mm or more;

pouring a thermosetting resin on the upper surface;

laying a unidirectional reinforcing fibersheet over the top of the resin, and impregnating the resin into the reinforcing fiber sheet while maintaining the reinforcing sheet in a stretched state with their ends supported;

adhering the reinforcing fiber sheet to the upper surface of the slab; and then hardening the impregnated resin, wherein said resin is selected from a group consisting of epoxy resin, unsaturated polyester resin and vinyl ester resin, and the resin has a viscosity of 5,000 cps or less at 20° C., a thixotropic index (TI) of 3 or less at 20° C., and a glass transition point (Tg) of 60° C. or above.

2. The method of reinforcing a concrete slab according to claim 1, wherein the viscosity at 20° C. of said resin is 2,000–4,000 cps.

3. The method of reinforcing a concrete slab according to claim 1, wherein the thixotropic index (TI) at 20° C. of said resin is 1–2.5.

4. The method of reinforcing a concrete slab according to claim 1, wherein the glass transition point (Tg) of said resin after hardening is 65°–80° C.

5. The method of reinforcing a concrete slab according to claim 1, wherein the amount of the said resin applied to the upper surface is 0.3–3.9 kg/m$^2$.

6. The method of reinforcing a concrete slab according to claim 1, wherein after laying the unidirectional reinforcing fiber sheet on top of the resin, the reinforcing fiber sheet is supported at the ends and maintained in a stretched state by driving anchor pins into the upper surface from the upper portion of the ends of the reinforcing fiber sheet.

7. The method of reinforcing a concrete slab according to claim 1, wherein the said resin contains 0.1–5.0 wt % of silane coupling agent.

8. The method of reinforcing a concrete slab according to claim 1, wherein the said concrete slab is a concrete slab of a road bridge having asphalt paving on the concrete surface.

9. The method of reinforcing a concrete slab according to claim 1, wherein after impregnating the resin into the unidirectional reinforcing fiber sheet, and before the impregnated resin hardens, sand having a grain size of 0.5–5.0 mm is spread over the reinforcing sheets by 1.0–5.0 kg/m$^2$.

10. The method of reinforcing a concrete slab according to claim 1, wherein the said unidirectional reinforcing fiber sheet is formed by arranging reinforcing fibers in a single direction on a supporting sheet through an adhesive layer.

11. The method of reinforcing a concrete slab according to claim 10, wherein said reinforcing fiber is carbon fiber.

12. The method of reinforcing a concrete slab according to claim 10, wherein said supporting sheet is glass mesh.

* * * * *